US005828162A

United States Patent [19]

Danroc et al.

[11] Patent Number: 5,828,162

[45] Date of Patent: Oct. 27, 1998

[54] FIELD EFFECT ELECTRON SOURCE AND PROCESS FOR PRODUCING SAID SOURCE AND APPLICATION TO DISPLAY MEANS BY CATHODOLUMINESCENCE

[75] Inventors: Joël Danroc, Granable; Danh Tran Van, Crolles, both of France

[73] Assignee: Commissariat a l'Energie Atomique, Paris, France

[21] Appl. No.: 546,396

[22] Filed: Oct. 20, 1995

[30] Foreign Application Priority Data

Nov. 8, 1994 [FR] France ..... 94 13371

[51] Int. Cl.[6] ..... H01J 19/00

[52] U.S. Cl. ..... 313/309; 313/336; 313/351; 313/495

[58] Field of Search ..... 313/309, 336, 313/351

[56] References Cited

U.S. PATENT DOCUMENTS 4,084,942 4/1978 Villalobos ..... 313/336
5,199,918 4/1993 Kumar .
5,225,820 7/1993 Clerc ..... 313/309
5,289,086 2/1994 Kane .
5,473,218 12/1995 Moyer ..... 313/309

*Primary Examiner*—Sandra L. O'Shea
*Assistant Examiner*—Joseph Williams
*Attorney, Agent, or Firm*—Oblon, Spivak, McClelland, Maier & Neustadt, P.C.

[57] ABSTRACT

A field effect electron source includes a grid electrode formed over an insulating layer that covers a cathode electrode formed on an insulating substrate. Holes are provided in the grid electrode-insulating layer structure, the holes extending to the cathode electrode formed on the insulating substrate. Electron emitting microheaps are formed within the holes above the exposed portions of the cathode electrode on the substrate. These microheaps each include at least a macropile of carbon diamond or diamond like carbon powder grains surrounded by the sidewalls of the hole.

10 Claims, 2 Drawing Sheets

FIELD EFFECT ELECTRON SOURCE AND PROCESS FOR PRODUCING SAID SOURCE AND APPLICATION TO DISPLAY MEANS BY CATHODOLUMINESCENCE

DESCRIPTION

1. Technical Field

The present invention relates to a field effect electron source.

The invention has the same field of applications as microtip electron sources.

In particular, the present invention is applied to the field of flat display means, also known as flat screens, as well as to the manufacture of pressure measuring gauges.

2. Prior Art

Field effect electron sources are already known, being the microtip electron sources referred to hereinbefore.

A microtip electron source comprises at least one cathode conductor on an electrically insulating substrate, an electrically insulating layer which covers said cathode conductor and at least one grid formed on said electrically insulating layer.

Holes are formed through the grid and the insulating layer above the cathode conductor. The microtips are formed in these holes and carried by the cathode conductor.

The apex of each microtip is substantially in the plane of the grid, which is used for extracting electrons from the microtips. The holes have very small dimensions, namely a diameter below 2 $\mu$m.

In order to produce a display using such a microtip electron source, a so-called "triode" system is produced. More specifically, a cathodoluminescent anode is placed in front of the source. The electrons from the source bombard the cathodoluminescent anode.

Other displays are known having a so-called "diode" structure. These other known displays comprise a cathodoluminescent anode placed in front of an electron source having carbon diamond or diamond like carbon layers for emitting electrons.

These layers are obtained by laser ablation or by chemical vapour deposition.

The carbon diamond or diamond like carbon emits electrons much more easily than the materials conventionally used for the production of microtips.

With carbon diamond or diamond like carbon, the minimum electric field as from which it is possible to obtain an electron emission can be twenty times lower than the minimum electric field corresponding to metals, such as e.g. molybdenum.

Unfortunately, the deposition of carbon diamond or diamond like carbon layers using the aforementioned methods takes place at high temperatures (approximately 700° C.). It is also impossible to directly obtain microtips by these methods.

The deposits obtained are continuous layers and not microtips.

The resulting displays are, as has been shown hereinbefore, of the "diode" type, which gives rise to a problem with respect to their addressing.

Thus, it is necessary to produce electron addressing systems permitting the application of voltages of several hundred volts to said means.

Moreover, the high temperature at which are formed the carbon diamond or diamond like carbon layers prevents the use of standard glass as the substrate for carrying these layers.

DESCRIPTION OF THE INVENTION

The present invention aims at obviating the aforementioned disadvantages.

It relates to a field effect electron source comprising:

- an electrically insulating substrate, at least one first electrode serving as the cathode conductor,
- an electrically insulating layer covering said cathode conductor,
- at least one second electrode serving as the grid, formed on the electrically insulating layer, holes being formed through said grid and the electrically insulating layer above the cathode conductor and
- elements able to emit electrons and formed in these holes and carried by the cathode conductor,
- said source being characterized in that said elements are microheaps containing carbon diamond or diamond like carbon particles.

The term microheaps is understood to mean a micropile of carbon diamond or diamond like carbon powder grains in direct contact with their closest neighbours and/or linked together by a metal.

For the same control voltage, the source according to the invention emits more electrons than a microtip source, due to the use of carbon diamond or diamond like carbon particles, which have a higher emissive power than conventional electron emitting materials, such as e.g. molybdenum.

Thus, when using a source according to the invention for e.g. producing a display, the latter has a greater brightness than a microtip means for the same control voltage.

For equal brightnesses, the display using a source according to the invention requires a control voltage below that necessary for a microtip means.

Moreover, the use of a source according to the invention leads to a system of the "triode" type, which requires control voltages lower than those necessary for devices or means of the "diode" type referred to hereinbefore and which use carbon diamond or diamond like carbon layers.

In the present invention, the microheaps can be formed from carbon diamond or diamond like carbon particles or can be made from such particles dispersed in a metal.

In the source according to the invention, the microheaps can be interconnected by a deposit of a metal used for consolidating these microheaps, the carbon diamond or diamond like carbon particles emerging from said deposit on the surface of the microheaps.

The invention also relates to a cathodoluminescence display means comprising a field effect electron source and a cathodoluminescent anode comprising a layer of a cathodoluminescent material and characterized in that the source is that forming the object of the invention.

The advantages of such a means compared with the known means using microtips and means comprising carbon diamond or diamond like carbon layers have been shown hereinbefore.

The present invention also relates to a process for the production of a field effect electron source in which:

- a structure comprising an electrically insulating substrate, at least one cathode conductor on said substrate, an electrically insulating layer covering each cathode conductor and an electrically conductive grid layer covering said electrically insulating layer is produced,
- holes are formed through the grid layer and the electrically insulating layer at each cathode conductor and
- in each hole is formed an element able to emit electrons, said process being characterized in that the elements are microheaps containing carbon diamond or diamond like carbon particles and are formed by electrophoresis or by the joint electrochemical deposition of metal and carbon diamond or diamond like carbon.

The process according to the invention can be performed with large surface substrates and thus makes it possible to obtain electron sources (and therefore display screens) having a large surface (several dozen inches diagonal).

Moreover, in the process according to the invention, the temperature at which the microheaps are formed is close to ambient temperature (approximately 20° C.).

Thus, for producing a source according to the invention, it is possible to use an ordinary (soda-lime) glass substrate without taking any special precautions.

It should also be noted that the process according to the invention is simpler than the microtip source production process because, unlike in the latter, use is made neither of a lift-off layer nor of vacuum deposition.

In addition, the baths necessary for performing the process according to the invention have a long life of several months.

According to a special embodiment of the process according to the invention, the microheaps formed by electrophoresis are then linked with the aid of a metal by electrochemical deposition in order to consolidate these microheaps.

Preferably, the carbon diamond or diamond like carbon particles have a size of approximately 1 μm or less than 1 μm. Preferably, use is made of nanometric powders.

These particles can be obtained from natural or artificial diamond or by a method chosen from among laser synthesis, chemical vapour deposition or physical vapour deposition.

The holes formed through the grid layer and the electrically insulating layer can be circular or rectangular. The size of said holes can be chosen within a range from approximately 1 μm to several dozen micrometers.

The structure in which is formed the microheaps according to the process of the invention is comparable to the structure in which microtips are formed for producing a microtip source.

However, the size of the holes formed in the structure for performing the process according to the invention can significantly exceed that necessary for performing a microtip source production process. This is highly advantageous bearing in mind the difficulties involves in obtaining small calibrated holes (below 2 μm) on large surfaces.

BRIEF DESCRIPTION OF THE DRAWINGS

The present invention will be better understood from reading the following description of embodiments given in a purely illustrative and non-limitative manner with reference to the attached drawings, wherein show.

DETAILED DESCRIPTION OF EMBODIMENTS

Figure 1:
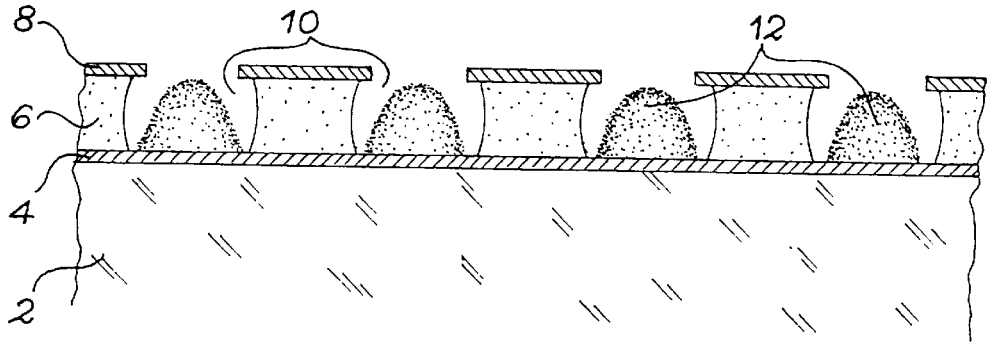
FIG. 1 A diagrammatic sectional view of an electron source according to the invention.

The source according to the invention diagrammatically shown in section in FIG. 1 comprises, on an electrically insulating substrate 2, electrodes 4 serving as cathode conductors (only one cathode conductor being visible in FIG. 1), an electrically insulating layer 6 covering each cathode conductor and electrodes 8 serving as grids and formed on the electrically insulating layer 6 (only one grid being visible in FIG. 1).

Holes 10 are formed through the grids 8 and the insulating layer 6 above the cathode conductors 4.

Microheaps 12 containing carbon diamond or diamond like carbon particles are formed in the holes 10 and carried by the cathode conductors 4. It is pointed out that the cathode conductors 4 are parallel and that the grids 8 are parallel to one another and perpendicular to the cathode conductors 4.

The holes 10 and therefore the microheaps 12 are located in zones where said grids cross the cathode conductors.

It is the microheaps of such a zone which emit electrons when an appropriate voltage is applied, by not shown means, between the cathode conductor 4 and the grid 8 corresponding to said zone.

Figure 2:
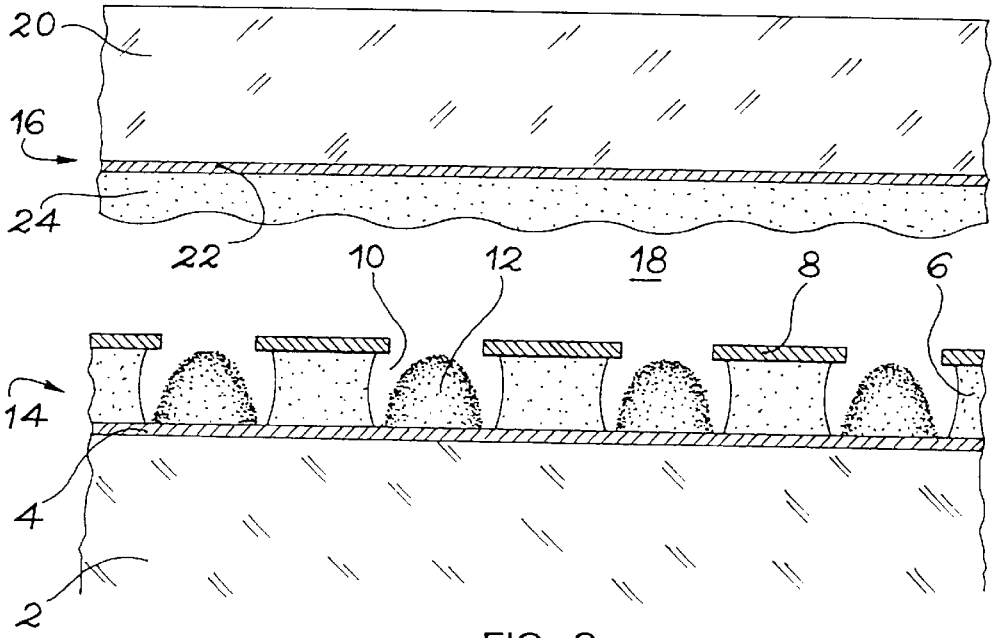
FIG. 2 A diagrammatic sectional view of a display means using the source of FIG. 1.

A cathodoluminescence display means is diagrammatically shown in section in FIG. 2. This means comprises the electron source 14 of FIG. 1.

The means of FIG. 2 also comprises a cathodoluminescent anode 16 positioned facing the source 14 and separated therefrom by a space 18 in which the vacuum is formed.

The cathodoluminescent anode 16 comprises an electrically insulating, transparent substrate 20 provided with an electrically conductive, transparent layer 22 forming an anode. The latter faces the electron source 14 and is covered, in front of said source, with a layer 24 of a cathodoluminescent material or phosphor.

Under the impact of electrons emitted by the source microheaps 12, said layer 24 emits a light which a user of the display observes through the transparent substrate 20.

This means can be compared with the display means described in documents (1) to (4) referred to hereinafter, but which has advantages compared therewith, as has been seen hereinbefore:

(1) FR-A-2 593 953 corresponding to EP-A-234 989 and U.S. Pat. No. 4,857,161

(2) FR-A-2 623 013 corresponding to EP-A-316 214 and U.S. Pat. No. 4,940,916

(3) FR-A-2 663 462 corresponding to EP-A-461 990 and U.S. Pat. No. 5,194,780

(4) FR-A-2 687 839 corresponding to EP-A-558 393 and U.S. application Ser. No. 08/022,935 of 26 Feb. 1993 (Leroux et al).

Figure 3:
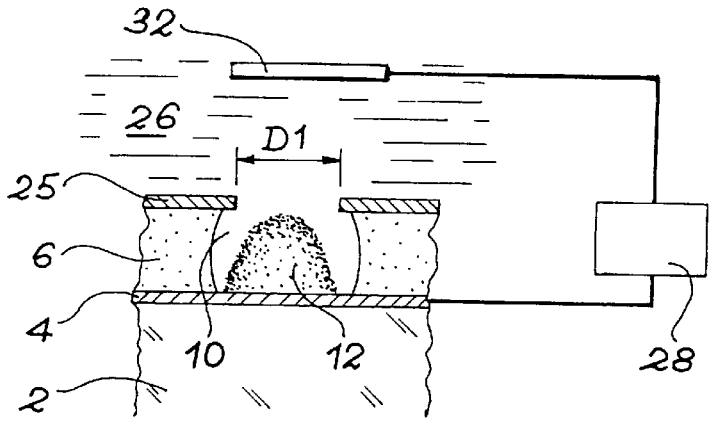
FIG. 3 Diagrammatically a process for producing an electron source according to the invention.

Details will be given hereinafter of a process for producing the electron source of FIG. 1 with reference to FIG. 3, which diagrammatically illustrates said process.

In order to produce said source, the first phase is to produce a structure comprising the substrate 2, cathode conductors 4, the electrically insulating layer 6, a grid layer 25 covering said electrically insulating layer 6 and the holes 10 formed in said grid layer 25 and the electrically insulating layer 6.

The production of such a structure is known and reference can be made in this connection to documents (1) to (4).

However, it is pointed out that the diameter D1 of the substantially circular holes formed in the grid 8 and in the electrically insulating layer 6 can advantageously exceed the diameter of the holes of the microtip electron sources described in (1) to (4). For example, the diameter D1 can be 1 μm to 20 μm.

FIG. 1 diagrammatically illustrates the fact that the holes 10, instead of being circular, can be rectangular.

Figure 4:
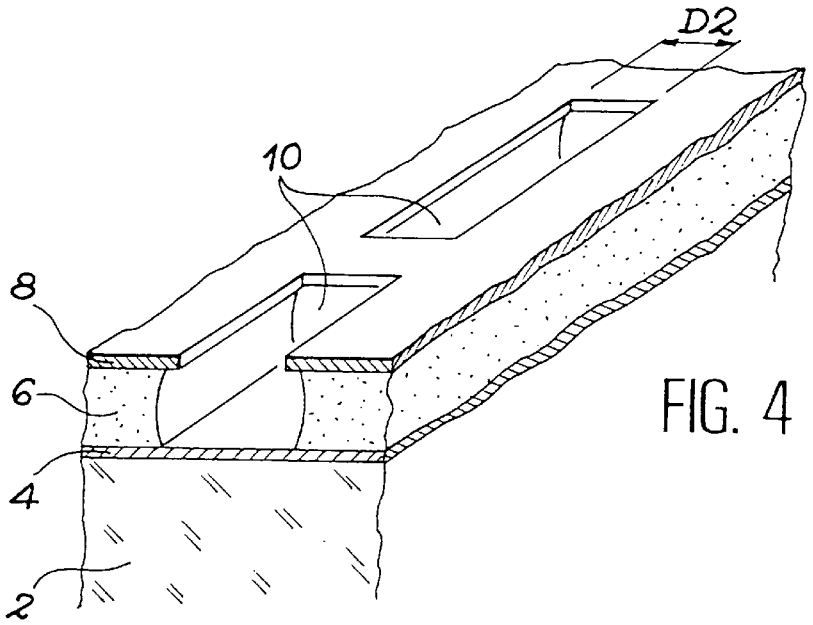
FIG. 4 Diagrammatically the possibility of using rectangular holes for producing a source according to the invention.

The width D2 of the rectangular holes 10 of FIG. 4 can be equal to the aforementioned diameter D1 and can therefore significantly exceed the diameter of the holes of microtip sources.

It is then a question of forming in the holes 10 the carbon diamond or diamond like carbon microheaps 12, after which formation will take place of the grids, perpendicular to the cathode conductors, by etching the grid layer 25.

Use is made of a carbon diamond or diamond like carbon powder for forming the microheaps 12. This powder can be obtained by chemical vapour deposition from a mixture of hydrogen and light hydrocarbons. This chemical vapour deposition can be assisted by an electron beam or by a plasma produced by microwaves.

It is also possible to synthesize this powder by means of a laser, i.e. more specifically by chemical vapour deposition, as hereinbefore, but assisted by laser.

It is also possible to synthesize the powder by physical vapour deposition from carbon (e.g. graphite) targets and a plasma forming gas such as argon alone or mixed with hydrogen, dopant-free hydrocarbons or having a dopant, such as e.g. diborane.

It is also possible to obtain this powder by laser ablation. It is also possible to use a natural diamond powder.

As a variant, it is possible to prepare artificial diamonds by carbon compacting at high pressure and temperature, followed by the production of the powder from said artificial diamonds.

Preferably, the carbon diamond and diamond like carbon powders are chosen so as to have a micron or submicron, but preferably nanometric grain size.

It is pointed out that these carbon diamond or diamond like carbon powders may or may not be doped. It is e.g. possible to use boron as the dopant.

The deposition of the powder (carbon diamond or diamond like carbon particles) leading to the formation of microheaps 12 in the holes 10 on the cathode conductors 4 can be carried out by electrophoresis (cataphoresis or anaphoresis), optionally completed by electrochemical metallic consolidation deposition or by the joint electrochemical deposition of metal and carbon diamond or diamond like carbon.

In the case of deposition by anaphoresis, the structure with the holes 10 is placed in an appropriate solution 26 and the bottom of each hole 10 is raised to a positive potential during said deposition phase.

More specifically, the cathode conductors 4 are raised to this positive potential by means of an appropriate voltage source 28, whose positive terminal is connected to said cathode conductors 4, whilst the negative terminal of said source is connected to a platinum or stainless steel counterelectrode 32 located in the bath at a distance from the substrate of 1 to 5 cm.

The fine powder of carbon diamond or diamond like carbon particles is suspended in the solution 26 (before placing the structure in said solution). The solution 26 e.g. incorporates acetone, an acid which can be sulphuric acid at 8 $\mu$l/liter of solution and nitrocellulose serving as a binder and dispersant.

The immersion of the structure in said solution and the application of the positive potential to the bottom of the holes leads to the obtaining of the microheaps 12.

The voltage supplied by the source 28 can be up to approximately 200 V.

In the case of cataphoresis, a negative potential is applied to the bottom of the holes.

More specifically, in this case, it is the negative terminal of the source 28 which is connected to the cathode conductors 4, whilst the positive terminal of the source 28 is connected to a platinum or stainless steel counterelectrode 32 located in the bath at a distance of approximately 1 to 5 cm from the substrate.

The solution 26 e.g. incorporates isopropyl alcohol, a mineral binder, such as e.g. $Mg(NO_3)_2$, $6H_2O$ (concentration $10^{-5}$ mole/liter) and a dispersant such as glycerin (whose concentration is approximately 1 vol. %).

Use is then made of a voltage up to approximately 200 V. The same type of deposit is obtained as in the case of anaphoresis.

With the aim of consolidating the deposit obtained by electrophoresis, following the latter it is possible to carry out an electrochemical deposition of a metal e.g. chosen from among Ni, Co, Ag, Au, Rh or Pt or more generally from among transition metals, alloys thereof and precious metals. This is diagrammatically illustrated in FIG. 5, where it is possible to see the structure provided with microheaps 12 and immersed in a solution 30 permitting such an electrochemical deposition.

An appropriate voltage is then applied between the cathode conductors 4 and an electrode 33 placed in said solution by means of a voltage source34.

Said electrode 33 is e.g. of nickel and the solution 30 e.g. contains 300 g/l of nickel sulphate, 30 g/l of nickel chloride, 30 g/l of boric acid and 0.6 g/l of sodium lauryl sulphate.

Use is e.g. made of a current of 4 A/dm$^2$.

Figure 5:
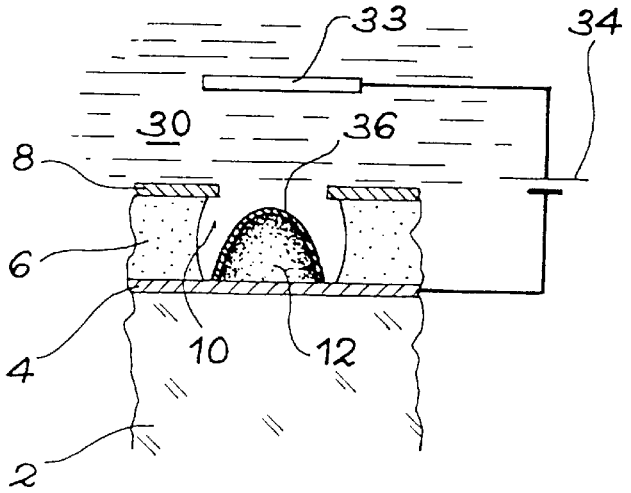
FIG. 5 Diagrammatically another process for producing an electron source according to the invention.

FIG. 5 shows the metal deposit 36 formed on each microheap 12 after said electrochemical deposition operation, permitting the appearance of emerging parts of the particles of the microheap.

It is also possible to form microheaps by the joint electrochemical deposition of metal and carbon diamond or diamond like carbon. To do this, use is e.g. made of a bath containing ions of nickel and diamond powder in suspension in said bath. It is possible to use up to 60 wt. % diamond suspended in the bath.

Use is made of an appropriate current source, e.g. approximately 4 A/dm$^2$, and the negative terminal of said source is applied to the cathode conductors and the positive terminal of said source to a nickel electrode placed in the bath.

The nickel is deposited in the holes entraining therewith the diamond particles, which leads to the formation of microheaps of nickel and diamond in said holes.

It is also possible to use in place of carbon diamond or diamond like carbon in the performance of the process according to the invention, a powder formed from silicon carbide or titanium carbide particles having a micron or submicron size, whilst using the same methods as hereinbefore (electrophoresis, optionally completed by an electrochemical metallic consolidation deposit, or a joint electrochemical deposit of metal and such particles), in order to form microheaps.

Obviously, in the present invention, the tops of the microheaps (optionally covered with a metallic consolidation deposit) are located substantially in the plane of the grids and these microheaps have no contact with said grids.

What is claimed is:

1. A field effect electron source comprising:

an electrically insulating substrate;

at least one cathode electrode located on said electrically insulating substrate;

an electrically insulating layer formed on said cathode electrode;

at least one grid electrode formed on the electrically insulating layer;

wherein the cathode electrode is at least partly exposed through holes formed through said grid electrode and the electrically insulating layer; and electron emitting elements formed in open areas defined by the holes on the cathode electrode, said electron emitting elements being microheaps surrounded by sidewalls of the holes with each microheap being a micropile of diamond or diamond like carbon power grains in direct contact with each other.

2. A field effect electron source comprising:

an electrically insulating substrate;

at least one cathode electrode located on said electrically insulating substrate;

an electrically insulating layer formed on said cathode electrode;

at least one grid electrode formed on the electrically insulating layer;

wherein the cathode electrode is at least partly exposed through holes formed through said grid electrode and the electrically insulating layer; and electron emitting elements formed in open areas defined by the holes on the cathode electrode, said electron emitting elements being microheaps surrounded by sidewalls of the holes with each microheap being a micropile of diamond or diamond like carbon powder grains dispersed in a metal.

3. The field effect electron source according to claim 1, wherein the powder grains are at least partially linked together by a metal with at least some of the diamond or diamond like carbon powder grains having portions emerging from said metal on an outer surface of the microheaps.

4. A cathodoluminescence display device comprising:

the field effect electron source according to claim 1; and a cathodoluminescence anode including a cathodoluminescence material layer.

5. A cathodoluminescence display device comprising:

the field effect electron source according to claim 2; and a cathodoluminescence anode including a cathodoluminescence material layer.

6. A field effect electron source comprising:

an electrically insulating substrate;

at least one cathode electrode located on said electrically insulating substrate;

an electrically insulating layer formed on said cathode electrode;

at least one grid electrode formed on the electrically insulating layer;

wherein the cathode electrode is at least partly exposed through holes formed through said grid electrode and the electrically insulating layer; and electron emitting elements formed in open areas defined by the holes on the cathode electrode, said electron emitting elements being microheaps surrounded by sidewalls of the holes with each microheap being a micropile of silicon carbide or titanium carbide power grains in direct contact with each other.

7. A field effect electron source comprising:

an electrically insulating substrate;

at least one cathode electrode located on said electrically insulating substrate;

an electrically insulating layer formed on said cathode electrode;

at least one grid electrode formed on the electrically insulating layer;

wherein the cathode electrode is at least partly exposed through holes formed through said grid electrode and the electrically insulating layer; and electron emitting elements formed in open areas defined by the holes on the cathode electrode, said electron emitting elements being microheaps surrounded by sidewalls of the holes with each microheap being a micropile of silicon carbide or titanium carbide powder grains dispersed in a metal.

8. The field effect electron source according to claim 6, wherein the powder grains are at least partially linked together by a metal with at least some of the silicon carbide or titanium carbide powder grains having portions emerging from said metal on an outer surface of the microheaps.

9. A cathodoluminescence display device comprising:

the field effect electron source according to claim 6; and a cathodoluminescence anode including a cathodoluminescence material layer.

10. A cathodoluminescence display device comprising:

the field effect electron source according to claim 7; and a cathodoluminescence anode including a cathodoluminescence material layer.

* * * * *